US005559541A

United States Patent [19]

Asanae et al.

[11] Patent Number: 5,559,541

[45] Date of Patent: Sep. 24, 1996

[54] DIRECT RECORDING METHOD

[75] Inventors: Masumi Asanae; Masahisa Ochiai, both of Kumagaya; Koji Noguchi, Tokyo, all of Japan

[73] Assignee: Hitachi Metals, Ltd., Tokyo, Japan

[21] Appl. No.: 502,066

[22] Filed: Jul. 14, 1995

Related U.S. Application Data

[63] Continuation of Ser. No. 217,180, Mar. 24, 1994, abandoned.

[30] Foreign Application Priority Data

Mar. 24, 1993 [JP] Japan ..... 5-087786

[51] Int. Cl.[6] ..... B41J 2/06

[52] U.S. Cl. ..... 347/55; 355/257

[58] Field of Search ..... 430/106.6, 109; 118/651; 355/257; 347/55

[56] References Cited

U.S. PATENT DOCUMENTS

| | | | |
|---|---|---|---|
| 4,433,042 | 2/1984 | Kawanishi et al. | 430/126 |
| 4,436,802 | 3/1984 | Ohtsuka et al. | 430/106.6 X |
| 4,652,509 | 3/1987 | Shirose et al. | 430/106.6 X |
| 5,064,739 | 11/1991 | Asanae et al. | 430/106.6 X |
| 5,147,744 | 9/1992 | Sacripante et al. | 430/106.6 X |
| 5,199,983 | 4/1993 | Katamoto | 430/106.6 X |
| 5,202,209 | 4/1993 | Winnik et al. | 430/106.6 |
| 5,232,805 | 8/1993 | Misawa et al. | 430/106.6 |
| 5,253,016 | 10/1993 | Behe et al. | 118/651 X |
| 5,296,879 | 3/1994 | Kagayama | 346/159 X |
| 5,305,061 | 4/1994 | Takama et al. | 355/219 |

FOREIGN PATENT DOCUMENTS

| | | |
|---|---|---|
| 4-355166 | 12/1992 | Japan . |
| WO90/14960 | 12/1990 | WIPO . |
| WO90/14959 | 12/1990 | WIPO . |

OTHER PUBLICATIONS

Database WPI, Section Ch, Week 9018, Derwent Publications Ltd., London, GB; Class G08, AN 90–136232 & JP–A–20 84 662 (Fuji Kagashuki), 26 Mar. 1990 –abstract.

*Primary Examiner*—Brian W. Brown
*Assistant Examiner*—Randy W. Gibson
*Attorney, Agent, or Firm*—Staas & Halsey

[57] ABSTRACT

In a direct recording method, toner supplied on a toner carrier contains at least fixing resin and magnetic grain, and has an apparent density of 0.5 g/cc or more and an angle of repose of 45° or less. The magnetic flux density on the toner carring member is 600 gauss or more. A doctor blade located in opposition to the toner carring member is used to restrain the thickness of toner layer formed on the toner carring member to 5 to 100 μm. When performing recording on a recording body with this invention, the image density is improved and fogging is eliminated.

4 Claims, 1 Drawing Sheet

DIRECT RECORDING METHOD

This application is a continuation of application Ser. No. 08/217,180, filed Mar. 24, 1994, now abandoned.

FILED OF THE INVENTION

The present invention relates to a direct recording method wherein a recording electrode is kept in non-contact with a recording medium such as paper, and toner images are formed by jumping toner out from a toner carring member and directly onto the recording medium.

PRIOR ART

Conventionally, an electrophotographic device has generally been used as a device for forming an image such as documents or figures on a recording medium. However, since in electrophotographic devices a means for forming latent images on the surface of an image carring member and a means for developing the images to be formed separately are required, the structure tends to be complex and large.

A direct recording method has thus been proposed wherein a recording electrode and a background electrode are located in opposition to each other on a toner carring member, a recording medium such as paper is transferred between the recording and background electrodes, a voltage corresponding to an image signal is then applied between the recording and rear electrodes to generate a static electricity force, and in response to the voltage applied, the magnetic toner is blown off from the toner carring member and onto the recording medium.

Configuration for various direct recording methods have been proposed. Among them is a method of using a recording electrode with a plurality of conductors disposed like a matrix, and simultaneously applying a voltage to each conductor to jump out magnetic toner retained on a magnet roll from the meshes of the recording electrode using static electricity and to selectively adhere it onto the surface of a recording medium (PCT laid open WO90/14959, PCT laid open WO90/14960).

Since this direct recording method uses a specific recording electrode, it can provide high quality images.

In this direct recording method, when the toner is jumped out from the toner carring member onto the recording medium, it passes through many small holes in the matrix-like recording electrode. Therefore, there is a disadvantage in this method that when the toner is jumped out from the toner carring member onto the recording medium, it contacts the recording electrode and is difficult to smoothly attach it on the recording medium, often resulting in bleeding images or splashing toner. In addition, since the toner attracted on the toner carring member cannot be stably retained, it is difficult for the toner to be accurately jumped out onto the recording medium in response to the voltage applied to the recording electrode.

OBJECT OF THE INVENTION

Therefore, it is the object of this invention to allow the toner to flow smoothly, to reduce the thickness of the toner layer formed onto the toner carring member, and to enable the toner carring member to retain toner properly, thereby improving image density and eliminating fogging.

In this invention, said objective is achieved by a direct recording method wherein a background electrode is located in opposition to a toner carring member with a sleeve provided on the outer surface of a magnet member having a plurality of magnetic pole on its surface, a matrix-like recording electrode is located between the toner carring member and the background electrode, and toner is jumped out from the toner carring member and onto a recording medium between the recording and the background electrodes. For this reason the toner supplied on the toner carring member contains at least fixing resin and magnetic powder, and has an apparent density of 0.5 g/cc or more, an angle of repose of 45° or less, and a magnetic flux density on a surface of the toner carring member of 600 gauss or more.

A doctor blade located in opposition to the toner carring member is used to regulate the thickness of the toner layer formed on the toner carring member to 5 to 100 μm.

A fluidity-improvement agent represented by an inorganic fine powder such as $SiO_2$, $Al_2O_3$, or $TiO_2$, or metallic salt of stearic acid such as zinc stearate or calcium stearate is added to the outer surface of the toner.

The surface of the toner carring member has a magnetic flux density of 600 gauss or more in order to retain the toner properly so as to prevent the image density from being reduced and the visibility of images from being degraded due to splashing.

The thickness of the toner layer formed on the toner carring member is regulated to 5 to 100 μm because otherwise, many toner particles will jump out from the toner carring member onto the recording medium and easily contact the small holes in the recording electrode to make high quality images difficult to obtain.

The toner has an apparent density of 0.5 g/cc or more and an angle of repose of 45° or less in order to have better fluidity, so that it can, jump out properly and smoothly pass from the toner carring member through the holes of the recording electrode onto the recording medium, thereby providing a high quality images.

Materials for the magnetic toner used for this invention are listed below. The fixing resin is set as appropriate depending upon the fixing method (see U.S. Pat. No. 4,433,042, for example). For example, styrene-acrylic copolymer, styrene-butadiene copolymer, polyester resin, epoxy resin, and mixed resins the reof are appropriate for a heat roll fixing method. An alloy or a compound such as ferrite or magnetite containing a ferromagnetic element such as iron, cobalt, or nickel can be used as the magnetic powder, and these particles should preferably have an average particle size of 0.1 to 3μm so as to be contained in the toner particles. The magnetic powder should preferably has a coercive force ($_iHc$) of 50 to 500 Oe.

A range of 10 to 60 wt. % is appropriate for the content of magnetic powder with respect to 100 wt. % of toner. If the content of magnetic powder is smaller than 10 wt. %, the saturation magnetization will be reduced, while if it is above 60 wt. %, the volume resistivity of the toner will be reduced due to its own conductivity, and the fixing property will also be degraded. Therefore, the preferable content is 20 to 40 wt. %.

A charge control agent can be added to the toner, and in this case, a known dye or pigment may be used. For example, a dye including a nigrosine dye having positive frictional electrification or a metal-ontaining azoic dye having negative frictional electrification are possible. The content of this charge control agent is preferably set within a range of 0.1 to 5 wt. % so as to obtain the, above charge amount.

To improve the fluidity of the toner particles, a inorganic fine particles such as silica ($SiO_2$), alumina ($Al_2O_3$), or titanium oxide ($TiO_2$) or metallic salts of stearic acid such as zinc stearate or calcium stearate is preferably added to the surface of the toner particles. The added amount should be 0.1 to 3 perts by weight relative to 100 parts by weight of toner particles. If the content is less than 0.1 parts by weight, the desired effect cannot be achieved, while if it is above 3 parts by weight, the particles will have too high a charging capability. To perform this addition, for example, the toner particles and an additive are simply fed into a publicly known dry mixer and then agitated for a specified period of time.

In the above direct recording method, since the toner retaining on the toner carring member contains at least fixing resin and magnetic powder and has an apparent density of 0.5 g/cc or more and an angle of repose of 45 ° or less, as well as a good fluidity, it smoothly passes the small holes in the recording electrode without degrading the image quality. In addition, 600 gauss or more of the intensity of developing pole (the magnetic flux density on the toner carring member) allows the toner to be retained properly and prevents instably retained toner from being jumped out in excess toward the recording medium, or from contacting the edge of the hole in the recording electrode.

Furthermore, since the doctor blade located in opposition to the toner carring member serves to regulate the thickness of the toner layer formed on the toner carring member to 5 to 100 μm, excess toner is not jumped out toward the recording medium, and uniform electro static force is applied to the toner to jump it onto the recording medium, thereby improving the image quality.

DETAILED DESCRIPTION OF EMBODIMENT

Figure 1:
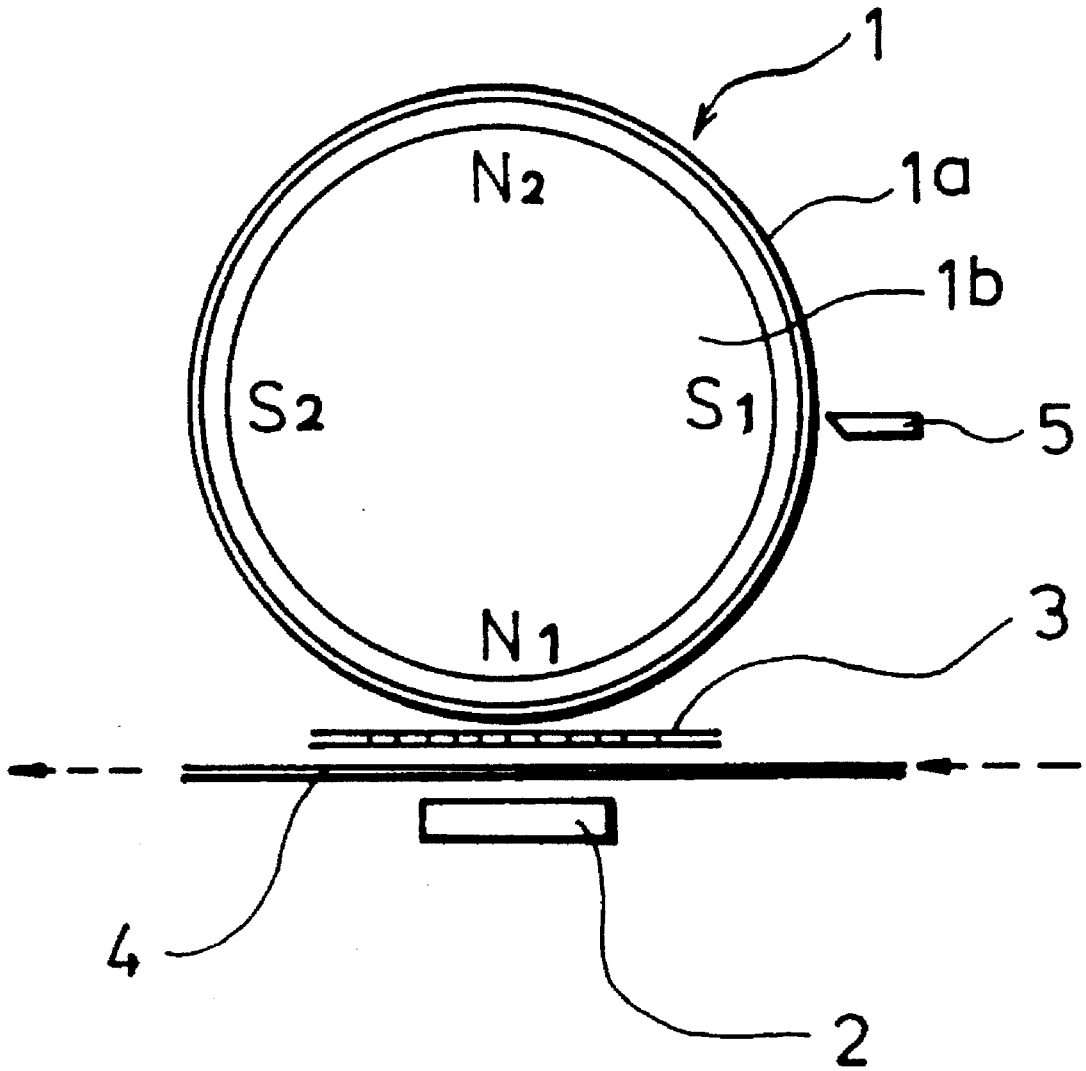
FIG. 1 is a schematic view of a device to which a direct recording method according to this invention is applicable.

A direct recording method according to this invention is implemented by a direct recording device shown in FIG. 1.

In this direct recording device, a background electrode 2 is located in opposition to a toner carring member 1, and a matrix-like recording electrode 3 is located between the toner carring member 1 and the background electrode 2. This device allows a voltage corresponding to images to be recorded to be applied to the recording electrode 3, and also allows a recording medium 4 such as paper to be transferred between the recording electrode 3 and the background electrode 2 to retain the toner on the toner carring member 1 to the recording medium 4.

A doctor blade 5 made from ferro-magnetic material such iron or steel is provided in opposition to the toner carring member 1 to regulate the thickness of the toner layer formed on a sleeve made from non magnetic and electro-conductive material, such as austenitic stainless steel or aluminume alloy, to a small value.

The toner carring member 1 comprises a roll-like permanent magnet member **1*b* with a plurality of magnetic poles (four in FIG. 1) on its surface inside of the sleeve 1*a* with an outside diameter of 32 mm manufactured by SUS 304. A DC voltage source is connected between the sleeve 1*a* and the background electrode 2. Magnetic toner is supplied onto the sleeve 1*a*, and the relative rotation of the sleeve 1*a* and the magnet body 1*b* is used to transfer the magnetic toner to the opposite side where the recording electrode 3** is located.

The toner used in the above direct recording device contains fixing resin and magnetic powder, and is added with a fluidity improvement agent in this invention. To provide fixing resin, 60 to 80 wt. % of polyester resin and 20 to 40 wt. % of magnetic powder were dry-mixed, heated, and kneaded, cooled and solidified, and finally crushed. 0 to 1.0 parts by weight of $SiO_2$ (H2000 manufactured by Wacker Inc.) was added to the 100 parts by weight of crushed toner particles as a fluidity improvement agent, and then mixed and classified to prepare magnetic toner with a volume average particle size of 7 μm, triboelectric charge of −50 μc/g, saturated magnetization of 20 to 25 emu/g, and a coercive force of 100 Oe. This magnetic toner was used for the direct recording device. As shown in Table 1, the apparent density of this embodiment is 0.5 to 0. 7 g/cc while that of a comparative example was 0.35 to 0.45 g/cc, and the angle of repose of this embodiment is 38° to 45° while that of the comparative example is 48° to 55°.

The triboelectric charge was measured by a blow off triboelectric charge measuring device (TB-200 type manufactured by Toshiba Chemical Inc.), and the magnetic toner and a ferrite carrier (Hitachi Metals KBN-100) were used to prepare a developer with a toner concentration of 5 wt. %. The magnetic characteristic of the magnetic toner was measured by using a vibration sample magnetometer (VSM-3 type manufactured by Toei Kogyo Inc.) applying a magnetic field of 10 kOe maximum. The particle size of the toner was measured by a coulter counter model T-11 (manufactured by Coulter Electronics Inc.).

To enable recording, the direct recording device was set as follows. A large number of holes were provided in the recording electrode 3 to allow the toner to pass through. The diameter of each hole was set to 0.2 mm, the gap between the recording electrode 3 and the sleeve **1*a* was set to 50 μm, and the gap between the recording electrode 3 and the background electrode 2 was set to 0.5 mm. The magnet member 1*b* in the toner carring member was fixed, the sleeve la was rotated at 150 rpm, the doctor gap was set to 0.1 mm, and plain paper was passed between the background electrode 2 and the recording electrode 3 at a speed of 50 mm/sec. A voltage of 1500 V was applied between the sleeve 1*a* and the background electrode 2, and a recording voltage of −300 V was applied to the recording electrode 3. The magnetic flux density on the sleeve at a magnetic pole $S_1$ opposed to the doctor blade 5** was set to 700 gauss while the magnetic flux density on the sleeve corresponding to magnetic poles $S_2$ and $N_2$ was set to 600 gauss. Toner images were formed on the surface of plain paper. Heat roll fixation was then performed at a fixing temperature of 180° C., a fixing pressure (line pressure) of 1 kg/cm, and a nip width of 4.0 mm.

The toner was used in the direct recording device set as described above to obtain images. Table 1 shows the results of evaluation.

TABLE 1

| | Comparative Example | | Embodiment | | | |
|---|---|---|---|---|---|---|
| | 1 | 2 | 1 | 2 | 3 | 4 |
| Magnetic powder (wt %) | 30 | 30 | 30 | 25 | 20 | 35 |
| $SiO_2$(parts by weight | 0 | 0.3 | 0.6 | 0.7 | 0.7 | 1.0 |
| Apparent density (g/cc) | 0.35 | 0.45 | 0.5 | 0.65 | 0.6 | 0.7 |
| Angle of repose(°) | 55 | 48 | 45 | 43 | 40 | 38 |

TABLE 1-continued

| | Comparative Example | | Embodiment | | | |
|---|---|---|---|---|---|---|
| | 1 | 2 | 1 | 2 | 3 | 4 |
| Magnetic flux density of the developing pole N (gauss) | 500 | 900 | 900 | 900 | 700 | 700 |
| Image density | 0.7 | 0.9 | 1.3 | 1.25 | 1.41 | 1.40 |
| Fogging | Yes | Yes | No | No | No | No |

As is apparent from Table 1, the image obtained by this embodiment is preferable because it has an image density of 1.25 or more, no fogging, and good quality. For the comparative example, neither image density nor fogging was preferable.

In the direct recording method according to this invention, since the toner supplied on the toner carrier has a good fluidity represented by an apparent density of 0.5 g/cc or more and an angle of repose of 45° or less, it smoothly passes through the small holes in the recording electrode to provide high quality images. In addition, the magnetic flux density of 600 gauss or more on the toner carring member allows the toner to be retained properly and prevents instably retained toner from being jumped out in excess toward the recording medium.

Since the doctor blade located in opposition to the toner carring member serves to regulate the thickness of toner layer formed on the toner carring member to 5 to 100 μm, excess toner is not jumped out toward the recording medium, and uniform electrostatic force is applied to the toner, thereby improving the image quality.

What is claimed is:

1. A direct recording method for forming a toner image on a recording medium employing a toner carrying drum comprising a magnetic roll disposed within a toner carrying sleeve which rotates around said roll and presents a toner carrying surface, a background electrode and a foraminous recording electrode located between said surface and said background electrode, and wherein the recording medium is placed between said background electrode and said recording electrode and the toner is caused to jump from said surface through said recording electrode onto said medium as a result of an electrical potential pattern corresponding to an image signal applied to said recording electrode, said method comprising the steps of:

providing a magnetic flux density of at least 600 gauss at said surface of the drum;

supplying said toner as a magnetic toner material having an apparent density of at least 0.5 g/cc and an angle of repose not greater than 45 degrees to said surface of the drum having said flux density, said magnetic material including a fixing resin and 10 to 60 weight percent of a magnetic powder having a coercive force of 50 to 500 Oe;

regulating the thickness of the toner material on said surface having said flux density so as to provide a toner layer having a thickness of 5 to 100 μm thereon; and transferring said layer from said surface to said recording medium while rotating said sleeve about said magnetic roll by applying an image signal voltage to said recording electrode.

2. A recording method as set forth in claim 1, wherein said toner material includes a magnetic powder having an average particle size of 0.1 to 3 μm.

3. A recording method as set forth in claim 1, wherein said toner material includes an inorganic fine powder as a fluidity improver.

4. A recording method as set forth in claim 3, wherein said toner inorganic fine powder is one or more of $SiO_2$, $Al_2O_3$, $TiO_2$ or a metallic salt of stearic acid.

* * * * *

UNITED STATES PATENT AND TRADEMARK OFFICE

CERTIFICATE OF CORRECTION

PATENT NO. : 5,559,541

DATED : September 24, 1996

INVENTOR(S) : Masumi ASANAE, et al.

It is certified that error appears in the above-identified patent and that said Letters Patent is hereby corrected as shown below:

ON THE TITLE PAGE, in section [73], Assignee:, after "Hitachi Metals, Ltd.," insert --and Array Printers AB--.

Signed and Sealed this

Second Day of February, 1999

*Attest:*

*Attesting Officer*

*Acting Commissioner of Patents and Trademarks*